United States Patent [19]

Johnson

[11] Patent Number: 5,039,242

[45] Date of Patent: Aug. 13, 1991

[54] Z-FOLD PAPER RETAINER

[75] Inventor: Richard F. Johnson, San Jose, Calif.

[73] Assignee: Spectra-Physics, Inc., San Jose, Calif.

[21] Appl. No.: 455,549

[22] Filed: Dec. 22, 1989

[51] Int. Cl.[5] ..... B41J 11/58

[52] U.S. Cl. ..... 400/613.2; 226/199; 312/208; 270/39; 493/410

[58] Field of Search ..... 400/613.2, 613.3, 613.4, 400/616.2, 642, 647; 226/199; 312/208; 270/39; 493/410; 211/45

[56] References Cited

U.S. PATENT DOCUMENTS

| | | | |
|---|---|---|---|
| 2,014,939 | 9/1935 | Lake | 400/613.2 |
| 4,515,490 | 5/1985 | Marker | 400/613.2 |
| 4,541,749 | 9/1985 | McCoy | 400/613.2 |
| 4,544,065 | 10/1985 | Mueller | 400/613.2 |
| 4,707,156 | 11/1987 | Clark | 312/208 |
| 4,749,295 | 6/1988 | Bankier et al. | 312/208 |
| 4,773,781 | 9/1988 | Bankier | 493/410 |
| 4,801,021 | 1/1989 | Hasser | 211/45 |
| 4,871,273 | 10/1989 | Fields | 226/199 |
| 4,923,188 | 5/1990 | Neir | 270/39 |

FOREIGN PATENT DOCUMENTS

| | | | |
|---|---|---|---|
| 0043008 | 1/1982 | European Pat. Off. | 400/613.2 |
| 1276050 | 10/1961 | France | 400/613.2 |

OTHER PUBLICATIONS

"Fan-Fold Paper Rack" IBM Technical Disclosure Bulletin, vol. 4, No. 1, 6/61, p. 1.

*Primary Examiner*—Eugene H. Eickholt

*Attorney, Agent, or Firm*—Hagan & Schaeff Killworth, Gottman

[57] ABSTRACT

A Z-fold paper elongated guide having a width approximately the with of Z-fold computer paper is positioned at the exit of a platen/printer carriage interface in a keyboard-operated computer printer or integrator. The guide not only guides printed-on paper sheets to a printed-on paper storage bin or surface but allows Z-fold paper sheets to be hand directed forwardly toward the computer keyboard for floor storage of the paper in front of the printer. A pair of hump-like rails extend on the top surface of the guide to open up the angle of repose between adjacent Z-fold sheets when the sheets are being reversed in driven direction so as to be transported back through the platen/printer carriage interface. The rails are sloped upwardly in a rearward direction at about 13° and extend to a position juxtaposed to but not touching a transverse rear tear edge of the guide. The rails open up the angle between the folded sheets as they approach the tear bar edge so that a sharp acute angle crease is not formed which would otherwise would tend to hand-up on the guide tear edge causing jamming or unwanted tearing of the Z-fold sheets.

12 Claims, 2 Drawing Sheets

Z-FOLD PAPER RETAINER

BACKGROUND OF THE INVENTION

This invention relates to a computer printer and means to properly guide Z-fold computer paper therein. More particularly the invention is directed to a paper retainer which allows Z-fold paper to pass into and out of the printer in a normal printing mode of operation and also allows for a Z-fold paper reverse mode of transport to allow re-insertion of the sheets into the printer in a reverse mode of operation for a subsequent second pass through the platen/printer interface.

In certain prior art computer printers or integrators, the Z-fold paper flow basically is unidirectional, namely it is transported from a paper supply bin or box to a printer platen where a print carriage of the jet type or thermal or laser type imprints data on the obverse side of Z-fold sheets. The printed-on sheets then exit from the printer carriage and platen and are folded into a printed-on paper bin or onto a folding surface. If it is necessary to have a capability which permits a user to hand guide the Z-fold paper so that the paper sheets exit to the front of the printer, i.e., drape over the keyboard and extend to the floor below a support table, it is necessary to reverse the paper drive so that the paper is pulled back into the printer and when placed in the forward mode of operation so that the paper can be overprinted with additional printed data. However, when the paper is reintroduced into the platen in a reverse mode of operation the sharp crease of the returning Z-fold paper can become wedged on a normally employed paper tear bar adjacent to the platen. This bar is included on prior art machines to guide the Z-fold paper rearwardly after it has been printed on and also to aid in ripping off one or more sheets from the stack of sheets along a rear relatively sharp edge of the tear bar. As a result of the wedging the paper traction drive becomes jammed stopping the printer. Further, Z-fold paper may rip or becomes partially torn making it difficult to re-feed the Z-fold paper back through the platen area toward the new paper storage bin. The wedging phenomenon is particularly apparent when a considerable weight of paper, such as multiple sheets extending to a floor, is being passed back through the platen.

SUMMARY OF THE INVENTION

Conventionally, a plastic tear bar, extending in a position on the printer at the exit of the Z-fold paper from the platen, has been employed previously to guide the exiting Z-fold paper rearwardly to a printed-on paper storage container such as that shown in U.S. Ser. No. 07/262,924, now U.S. Pat. No. 4,923,188. Other storage bins of known configurations such as paperboard shipping cartons used for shipping the Z-fold paper can be employed. New Z-fold paper normally enters the platen from a rearwardly disposed paper bin typically as shown in the above U.S. Patent. Tear bars have also had a transverse rear sharp knife-like edge which is used to tear off one or a group of paper sheets at that rear edge. It is desirable at times to direct the Z-fold paper, which has already passed through the platen and printer carriage interface, and has been imprinted with printed indicia thereon, out of the printer forwardly. Once redirected from its normal direction out of the printer and extending over the printer keyboard, the printed-on paper can be reintroduced into the platen in a reverse mode of operation and then, upon start of a forward mode of operation can be transported to the storage bin without any reprinting. Alternatively, the Z-fold paper which has been returned through the platen/printer carriage interface can be overprinted with additional data, graphical material or color indicia in a second pass and then directed back to the printed-on paper storage bin.

Z-fold paper usually of 24.2 cm width is made by transversely creasing a continuous roll of paper having edge perforations, first with a medium transverse crease and then in a sharp or tight transverse crease. The sharp crease is employed in between those adjacent sheets which will have the obverse side printed-on surfaces at an acute angle in a fan condition of the sheets. The medium crease is made where the angle between what will be the printed-on surfaces of one of the two adjacent sheets with a third adjacent sheet is an obtuse angle between those printed-on surfaces of the sheets, i.e., the acute angle is on the reverse side of the Z-fold sheets. When the Z-fold sheets are to re-reversed from a position over the keyboard or in front of the printer, i e., in the reverse mode of operation, the sharp inner crease particularly forms an acute angle "hook" as it progresses from the relatively smooth top surface of the tear bar to the transverse tear edge where it reverses direction to re-enter the platen/printer carriage interface. This "hook" intermittently catches on the tear edge and stops the paper transport.

The inclusion of the hump-like spaced rails of the invention on the top of the guide, in a reverse mode of paper transport, prevents both creases of the Z-fold paper from becoming oriented in a acute angle, i.e., an included angle of from 0° to about 70°. In the preferred embodiment the hump-like spaced integral rails on the top surface of the guide prevent either crease, but particularly the sharp crease, from having an included angle of less than about 75°, preferably permitting an angle of from about 80° to about 90° as the folded sheets approach the tear bar. In a commercial embodiment the preferred angle is about 82°. This angle results when the angle between a ramp upper surface portion of the rails and the flat top surface of the tear bar therebetween is at least 13°. The 75° to 90° paper sheets angle prevents hang-up of the sheets on the tear bar in a paper sheets reverse mode of operation.

DETAILED DESCRIPTION

Figure 1:
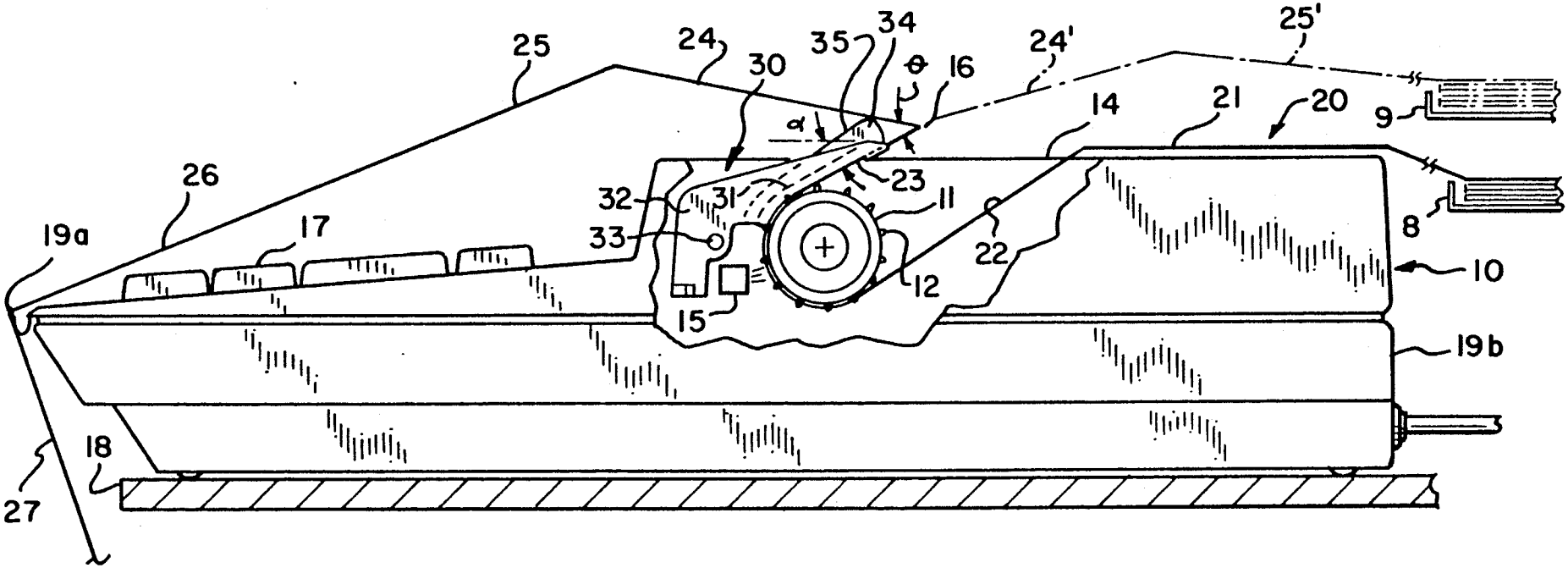
FIG. 1 is a schematic broken-away side view of the printer incorporating the guide of the invention and showing the transport of Z-fold paper in a forward print mode of operation, hand reverse and a reverse mode of operation.

FIG. 1 shows a printer 10 having a transversely disposed rotary platen 11 in the form of a cylindrical element driven by a traction drive (not shown). A 1.8° stepper motor (not shown) with gear box reduction resulting in an approximate 2 pound pulling force is employed.

The platen has end sections including paper-engaging pins 12 engaging edge perforations of the Z-fold paper 20 for transporting the paper sheets from a folded paper storage bin 8 to a platen/print station interface through a slotted aperture printer entrance 14. Z-fold paper as is well known, includes a sharp crease with considerable return memory between two sheets and then a medium crease which results in a greater included fold angle with the next sheet. After indicia has been printed on an obverse side of the Z-fold paper by a jet printer 15 or the like, the paper is guided by the underside of a paper guide 30 to a paper exit 16 on the top of the printer forward of entrance 14. The guide is in the form of an elongated shelf. In the normal print mode of operation the paper then exits rearwardly to be refolded automatically in a printed-on paper receiving bin 9, normally positioned behind the rear 19*b* of the printer. Bins 8 and 9 may be combined into a single Z-fold paper carrier which is the subject of U.S. Ser. No. 07/262,924, now U.S. Pat. No. 4,923,188. In the printer forward mode of operation the sheets 20 which move rearwardly from exit 16 to bin 9 are denoted by dash lines 24' and 25'. Prior art guides have been positioned similarly to the position of guide 30. When it is desired to reverse the paper direction the traction drive is reversed, which then rotates the platen and the perforated paper drive in the opposite direction pulling the paper sheets, e.g., sheets 24', 25' and succeeding sheets from bin 9 back through the platen/jet printer interface. This reversal may be desired to "back-up" a number of sheets, start the drive back to a forward direction of operation and then re-pass the sheets, e.g., sheets 24', 25', back through the platen/jet printer interface for overprinting with additional indicia. In another mode of operation it is desired that the operator have the ability to stack sheets on the floor forwardly of the printer. To accomplish this the operator merely flips sheet 24' forward with sheet 25' following so that these and other connected sheets extend over the guide 30 and keyboard 17 in a drape-form and build up in a stack as more sheets exit the printer. Prior connected sheets 26, 27 of paper may extend over the front edge 19*a* of the printer 10 and if enough sheets are allowed to exit forwardly in the path shown by sheets 24, 25, 26, 27 et al., the sheets can be stacked or piled on a floor surface (not shown) below a support table or shelf 18 on which the printer rests.

In the prior art guide when it is then desired to reverse the device so that the forwardly disposed paper sheets are drawn back into exit 16, the sharp creases on the folds of the Z-fold paper result in a fold angle of 0° to 70°. This angle can act as a "hook" and catch on the tear edge resulting in the tearing, crinkling or jamming of the Z-fold paper, particularly in the area between exit 16 and platen 11. The present invention obviates this problem by providing a hump-like pair of rails 34 having an upper surface 35 which slopes upwardly in a rearward direction so that the fold angle of both the sharp crease and medium crease increases to the order of from about 75° to about 90°, preferably about 82°, so that a more substantial fold angle $\theta$ is provided which successfully guides the connected sheets 23, 24, 25, 26, 27 back into entrance 16 without any hang-up due to either the medium or sharp creases of the Z-fold paper at the guide tear edge. The guide 30 is normally made of clear polycarbonate plastic and includes a pair of integral legs 32 extending parallel to the upper surface rails 34 and positioned outward of the rails. The inside vertical edges of the legs are spaced apart sufficiently so that the horizontal edges of the legs act to support the side edges of Z-fold paper outboard of its perforations. Integral pintles 33 extend outwardly from an angular portion 39 of the legs into side apertures in the printer casing so that the guide can be held in place and pivoted when desired to provide for access into the platen/-printer-jet interface.

Figure 3:
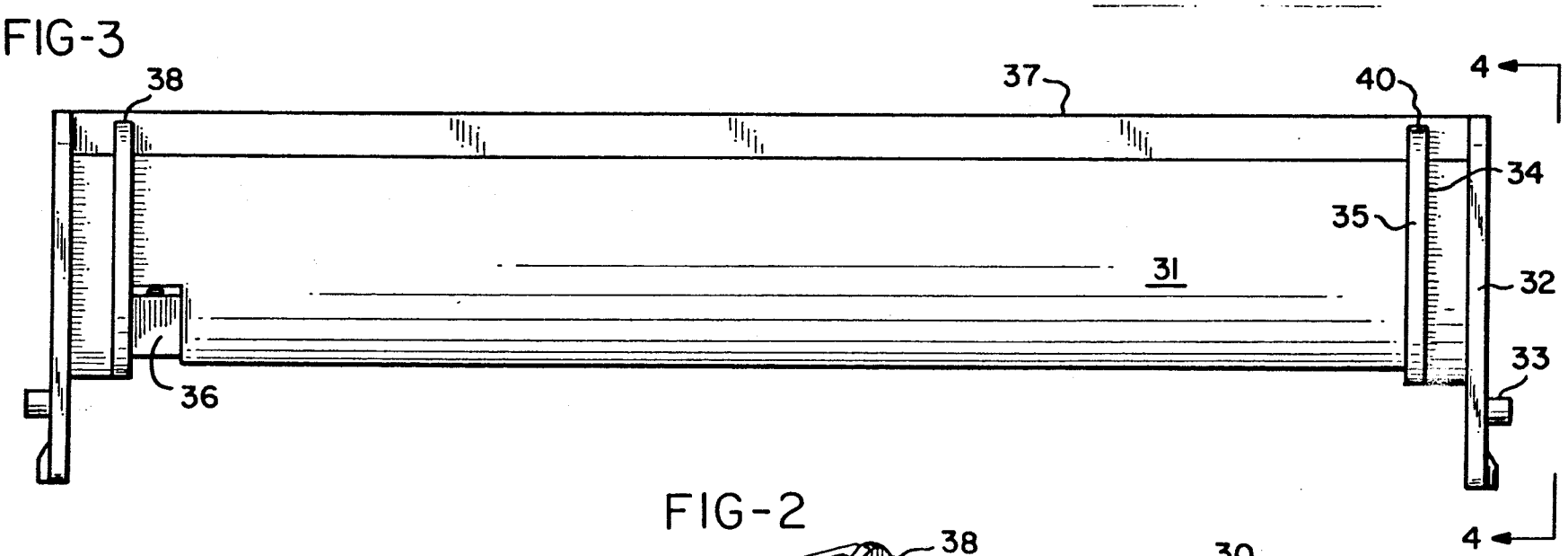
FIG. 3 is a top plan view of the guide.
Figure 2:
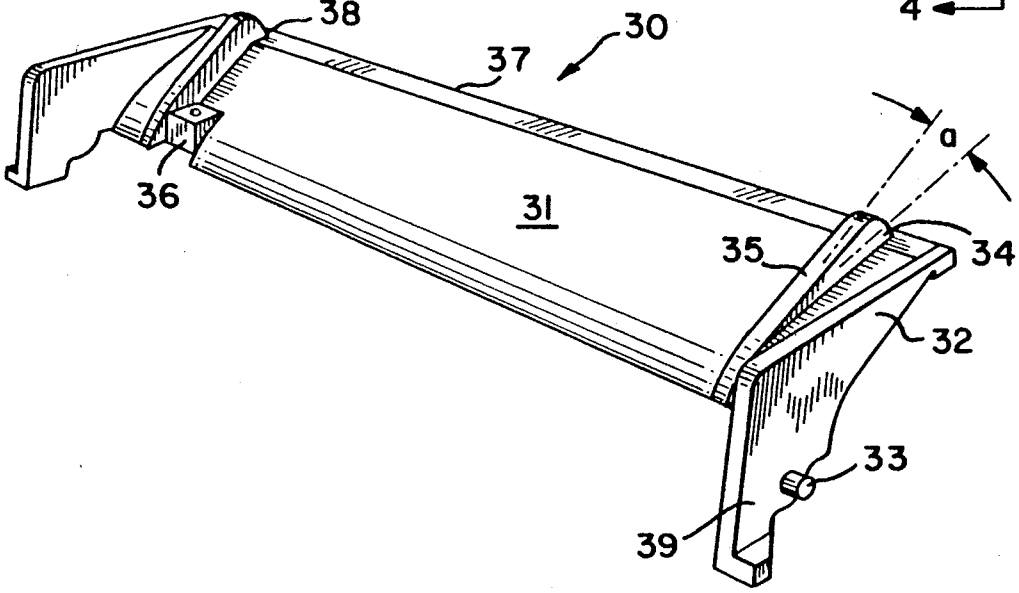
FIG. 2 is a perspective view of the guide.
Figure 4:
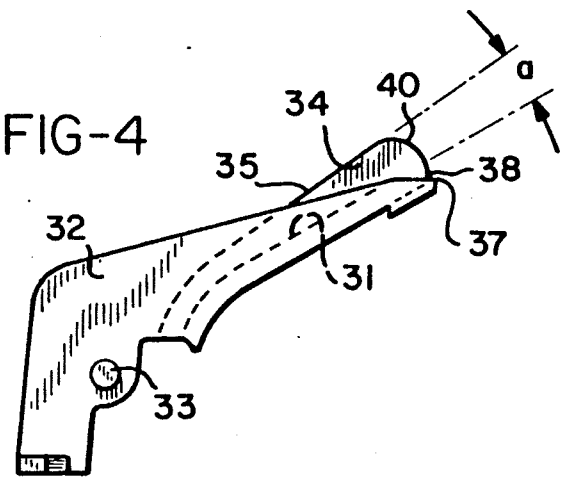
FIG. 4 is an end view of the guide.

FIGS. 2–4 more clearly show the construction of the guide particularly the beveled rear tear edge 37, the generally flat top surface 31, the hump-like rails 34 having an upwardly and rearwardly sloped upper surface 35, the guide legs 32 and pintles 33. A boss 36 is adapted to receive a blotter-holding spring tab (not shown). The blotter functions to blot up a test strip of ink on the paper in a printer start-up phase. It forms no part of the present invention. It is also seen that the rear end 38 of the rails 34 do not extend all the way to the tear edge so that the rails do not interfere with the overall tear edge which extends from and includes a similarly beveled width of the rear edge of the guide legs 32. The slope of the upper surface 35 with respect to surface 31 is denoted by the angle. In a commercial embodiment, the rail has an angle of 13°. This angle is not critical since the key dimension is the height of the rail adjacent the tear bar rear edge. This height is preferably from about 0.7 cm to 3 cm as measured from the top of the hump to its intersection with the guide at rear edge 38. A rail curved end 40 most clearly shown in FIG. 4 extends to a rail rear end 38 which rear end is spaced normally about 2 mm from the tear edge.

The above description of a preferred embodiment of this invention is intended to be illustrative and not limiting. Other embodiments of this invention will be obvious to those skilled in the art in view of the above disclosure.

I claim:

1. In combination, a computer printer cylindrical platen operable in a forward print mode of operation and alternatively in a reverse mode of operation and a Z-fold paper guide, said guide comprising an elongated member extending in substantially coextensive parallelism with said cylindrical platen adjacent a juxtaposed Z-paper exit from said platen; said guide including:

first means on an underside of said guide for guiding in one direction Z-fold paper exiting from moving abutment with said cylindrical platen at a paper exit in the print mode of operation;

said guide being positioned such that Z-fold paper sheets are hand-movable over said guide in a direction opposite said one direction; and second means extending upwardly from an upper side of said guide for preventing adjacent sheets of Z-fold paper reentering said platen at said paper exit from contacting one another in a paper reverse mode of paper movement.

2. The combination of claim 1 further including a printer housing having a finger-operated front keyboard;

a paper supply positioned rearwardly of said housing;

a printed-on paper bin positioned rearwardly of said housing for receiving paper exiting from said platen at a juxtaposed paper exit; and wherein said printed paper is guided into a position covering said keyboard prior to said paper reverse mode of operation.

3. The combination of claim 1 wherein said first means comprises a longitudinal generally flat surface on said guide overhanging a rear portion of said platen and wherein a Z-fold paper supply is fed into said platen through a paper entrance under said flat surface.

4. The combination of claim 3 wherein said first means includes a curved undersurface portion juxtaposed to a top surface of said platen.

5. The combination of claim 4 wherein said second means comprises a pair of spaced rails on a top surface of said guide, said rails extending above a longitudinal rear tear edge of said guide for increasing the fold angle of paper sheets entering said paper exit in a reverse mode of operation.

6. The combination of claim 1 wherein said first means includes a curved undersurface portion juxtaposed to a top surface of said platen.

7. The combination of claim 1 wherein said second means comprises a pair of spaced rails on a top surface of said guide, said rails extending above a longitudinal tear edge of said guide for increasing the fold angle of paper re-entering said platen at said paper exit in a reverse mode of operation.

8. The combination of claim 7 in which said fold angle is increased to an angle of from about 75° to about 90° by said sheets being guided by said rails into a more open angle condition.

9. In combination, a printing platen, a Z-fold paper entrance, a Z-fold paper exit, means for forward feeding and reversing Z-fold paper into and out of said platen, and a Z-fold paper guide;

wherein said platen comprises a horizontal cylindrical member, including means for rotatively moving said member in one direction to feed Z-fold paper through said entrance and in a reversed direction to return Z-fold paper back through said exit; and wherein said paper guide comprising a longitudinally elongated shelf substantially coextensive with and in parallelism with and juxtaposed above said cylindrical member at said paper exit, said guide including an undersurface for guiding Z-fold paper exiting from against said cylindrical member in a printing mode of operation, said paper being carried by said cylindrical member for printing and exiting from said platen, and means on a top surface of said guide for increasing the paper fold angle paper in a paper reverse mode of operation and at which paper is fed back over the guide and into said paper exit.

10. The combination of claim 9 wherein said means for increasing the fold angle comprises a pair of spaced rails extending above said guide top surface, said rails having an upper surface sloped upwardly front to back and a curved back end extending to a position adjacent to but not touching a longitudinal transverse rear tear edge of said guide.

11. The combination of claim 10 in which said upper surface slope of said rails is about 13° from said guide top surface.

12. The combination of claim 10 in which said upper surface slope increases the paper fold angle from less than 70° to from about 75° to about 90°.

* * * * *